US005400976A

United States Patent [19]

Kaijyu et al.

[11] Patent Number: 5,400,976

[45] Date of Patent: Mar. 28, 1995

[54] FRICTIONAL ELECTRIFICATION GUN

[75] Inventors: Haruhisa Kaijyu, Kobe; Kenji Horita, Izumi, both of Japan

[73] Assignee: Matsuo Sangyo Co., Ltd., Osaka, Japan

[21] Appl. No.: 251,965

[22] Filed: Jun. 1, 1994

[30] Foreign Application Priority Data

| | | | |
|---|---|---|---|
| Jun. 2, 1993 | [JP] | Japan | 5-131764 |
| Jun. 14, 1993 | [JP] | Japan | 5-142056 |
| Sep. 17, 1993 | [JP] | Japan | 5-231825 |

[51] Int. Cl.[6] ..... B05B 5/02

[52] U.S. Cl. ..... 239/692; 239/704; 239/708; 239/433

[58] Field of Search ..... 239/690.1, 692, 690, 239/696, 697, 698, 704, 708, 433, 590.3

[56] References Cited

U.S. PATENT DOCUMENTS

| | | | |
|---|---|---|---|
| 4,316,582 | 2/1982 | Kobayashi et al. | 239/704 |
| 4,359,192 | 11/1982 | Takahashi et al. | 239/692 |
| 4,399,945 | 8/1983 | Ruud | 239/697 |
| 4,597,534 | 7/1986 | Ruud | 239/704 |
| 4,659,019 | 4/1987 | Talacko | 239/692 |
| 4,706,890 | 11/1987 | Talacko | 239/692 |
| 4,798,340 | 1/1989 | Vohringer et al. | 239/692 |
| 4,886,215 | 12/1989 | Ruud | 239/696 |
| 4,979,680 | 12/1990 | Bauch et al. | 239/692 |
| 5,344,082 | 9/1994 | Haller et al. | 239/697 |

FOREIGN PATENT DOCUMENTS

| | | | |
|---|---|---|---|
| 0134841 | 3/1979 | Germany | 239/704 |
| 3430275 | 2/1986 | Germany | 239/692 |
| 2066703 | 7/1981 | United Kingdom | 239/708 |
| 0939106 | 7/1982 | U.S.S.R. | 239/708 |
| 1435308 | 11/1988 | U.S.S.R. | 239/704 |
| 92011950 | 7/1992 | WIPO | 239/704 |

*Primary Examiner*—Andres Kashnikow
*Assistant Examiner*—Christopher G. Trainor
*Attorney, Agent, or Firm*—Wenderoth, Lind & Ponack

[57] ABSTRACT

A frictional electrification gun for use in electrostatic painting which can electrostatically charge power paint to a sufficient degree without the need of an elongated and twisted charging portion made up of nonconductive resin tubes. At the inlet of the charging portion made up of nonconductive resin tubes is provided a pre-charging portion for dispersing and charging powder paint. It has a nonconductive resin ring through which powder paint is fed swirling along its inner surface. The paint is thus sufficiently charged.

11 Claims, 4 Drawing Sheets

FRICTIONAL ELECTRIFICATION GUN

This invention relates to a frictional electrification gun for electrostatic painting in which powder paint is electrically charged by the friction between the paint and a nonconductive polymer produced when they are brought into contact with each other.

Such a frictional electrification gun comprises a gun body having at one end a paint inlet and at the other end a paint outlet, and a paint charging portion in the form of a non-conductive resin tube provided in the gun body.

In order to sufficiently charge a powder paint with such a frictional electrification gun, the paint has to be brought into contact with the nonconductive resin tube as many times as possible.

Thus, conventional frictional electrification guns were rather long. In fact, they were too long to be fitted on reciprocators and painting robots. Their application was thus limited.

In a conventional frictional electrification gun, the nonconductive resin tube is twisted many times (50–70 times) to increase the number of times the paint is brought into contact with the tube. Such a gun has a problem in that the inner surface of the nonconductive resin tube tends to be worn severely and thus the tube is likely to be broken soon. Another problem is that it is practically impossible to change the color of the paint because it is difficult to completely remove old paint sticking on the inner surface of the twisted nonconductive resin tube by blowing air thereinto.

An object of the present invention is to provide a frictional electrification gun which can impart sufficient electric charges to powder paint without the necessity of prolonging the entire length of the gun or twisting the nonconductive resin tube.

In order to attain the above object, according to this invention, there is provided frictional electrification gun for use in electrostatic painting comprising a gun body having a paint inlet at one end thereof and a paint outlet at the other end, and a charging portion comprising a nonconductive resin tube, characterized in that there is provided between the paint inlet and the charging portion a pre-charging portion comprising a nonconductive resin ring and a flow member for directing the powder paint introduced through the paint inlet toward the inner wall surface of the nonconductive resin ring.

Since the powder paint is directed toward the inner wall of the nonconductive resin ring by the flow member, it is fed swirling in the nonconductive resin ring. The paint is thus dispersed. The dispersed paint is charged by being brought into contact with the inner wall of the nonconductive resin ring.

The powder paint thus pre-charged is then introduced into the charging portion made up of the nonconductive resin tubes. Thus, the powder paint can be charged stably and sufficiently.

This makes it possible to shorten the overall length of the gun. Also, there is no need to twist the nonconductive resin tubes forming the charging portion.

According to this invention, powder paint is charged and dispersed in the pre-charging portion having the nonconductive resin ring before introducing it into the charging portion which comprises the nonconductive resin tubes. Thus, powder paint can be charged sufficiently with a short charging portion and without the need of twisting the nonconductive tubes in the charging portion.

Other features and objects of the present invention will become apparent from the following description made with reference to the accompanying drawings, in which.

Figure 1:
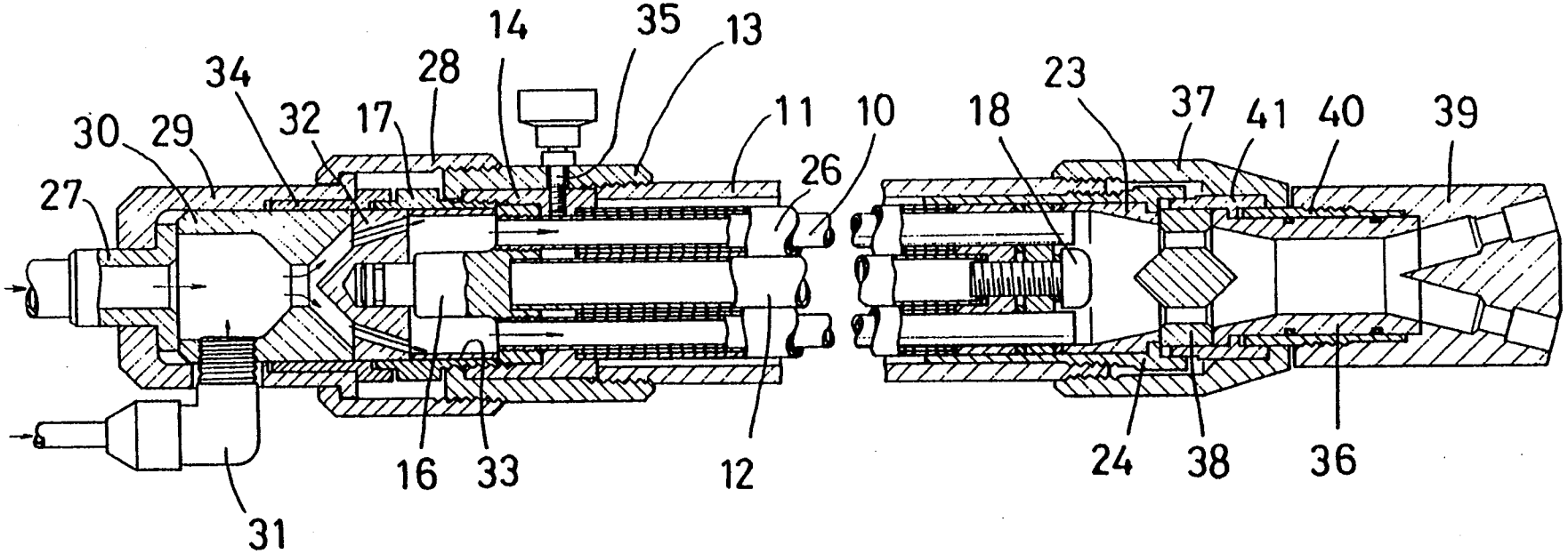
FIG. 1 is a vertical sectional front view showing one embodiment of the frictional electrification gun according to this invention.

Referring to the drawings, the frictional electrification gun according to this invention comprises a gun body 11 having a paint inlet at one end and a paint outlet at the other end, a charging portion in the form of nonconductive resin tubes 10 provided in the body 11, and a pre-charging portion provided on one side of the charging portion near the inlet.

Figure 2:
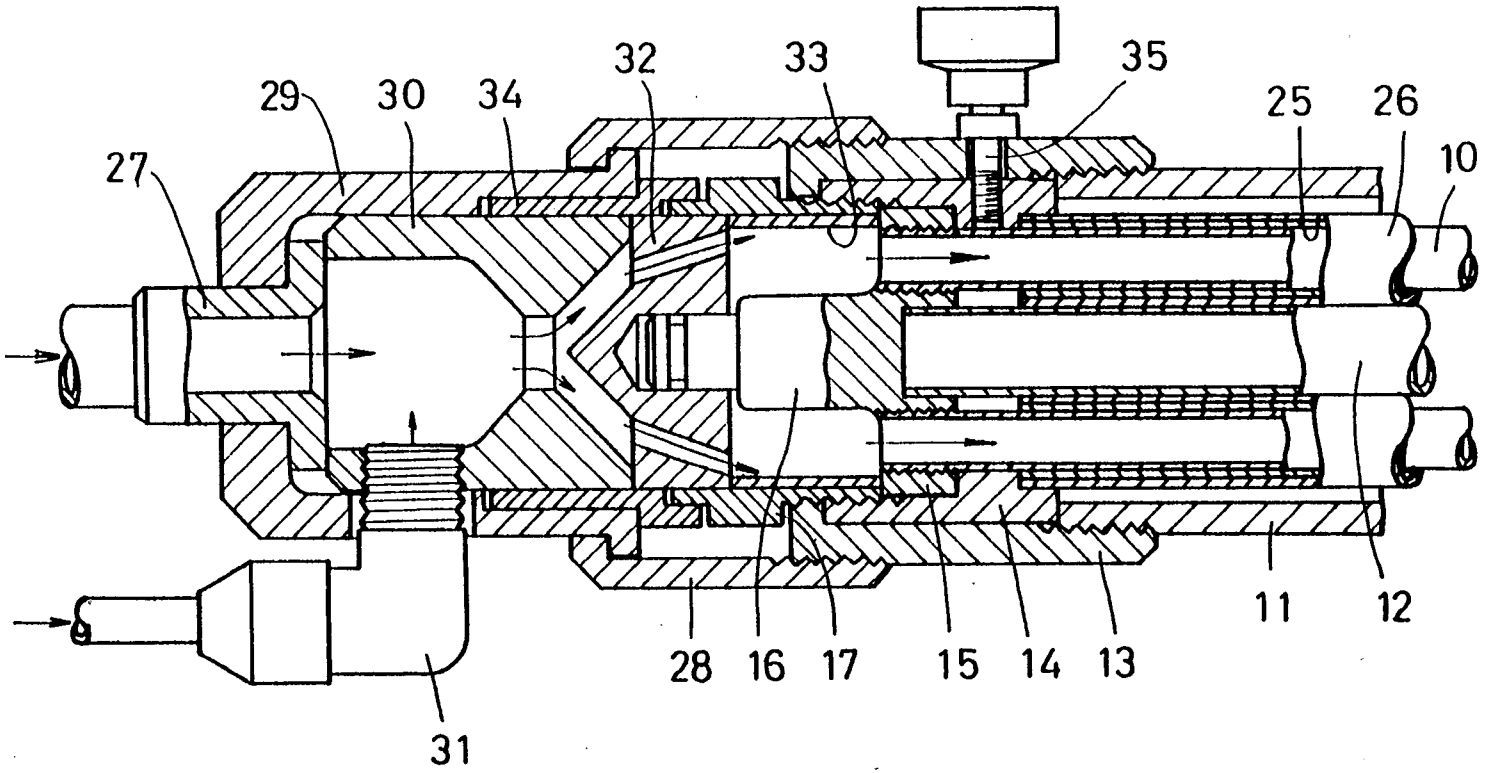
FIG. 2 is an enlarged view of the rear half of FIG. 1.
Figure 4:
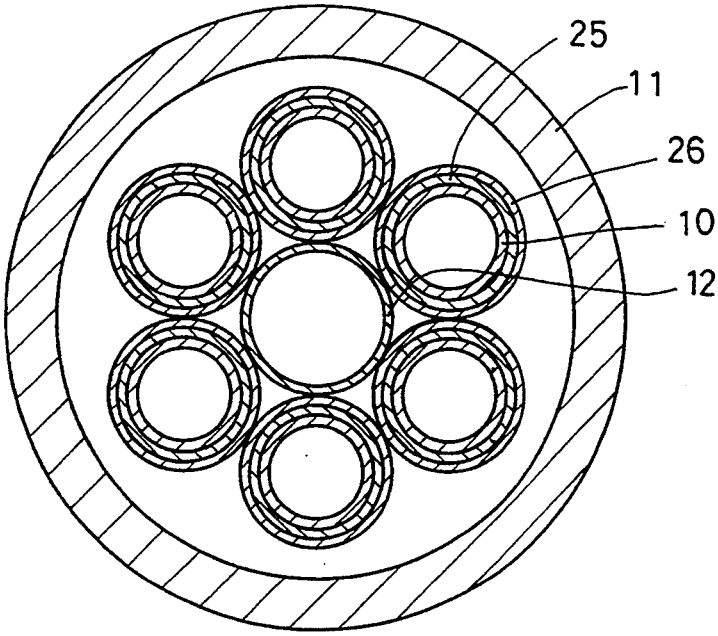
FIG. 4 is a vertical sectional view of FIG. 1.

More specifically, the gun body 11 is a cylindrical member made of resin. The charging portion comprises a center pipe 12 and six straight nonconductive resin tubes 10 arranged around the center pipe 12 at equal intervals (FIG. 4). A rear barrel cap 13 is put on the rear end of the gun body 11. Inside the rear barrel cap 13 is fitted a rear bundle holder 14, in which are further fitted a rear bundle cap 15 (FIG. 2) for supporting the rear end of the center pipe 12 and the rear ends of the nonconductive resin tubes 10, which are provided around the center pipe 12.

The rear bundle cap 15 is formed with supporting holes for supporting the rear ends of the nonconductive resin tubes 10, whose rear ends are open, and with a blind supporting hole for supporting the rear end of the center pipe 12, whose rear end is not open. The cap 15 is also provided with a protrusion 16 at the rear of the blind supporting hole.

A bundle cap stopper 17 is screwed into the rear end of the rear bundle holder 14 until it abuts the rear end of the rear bundle cap 15.

Figure 3:
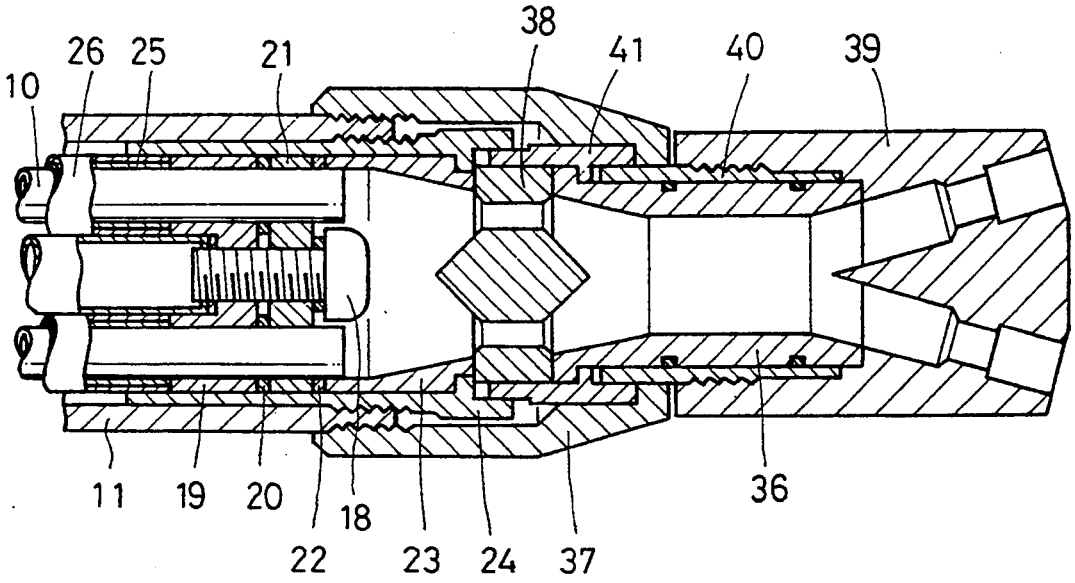
FIG. 3 is an enlarged view of the front half of FIG. 1.

On the other hand, the front ends of the nonconductive resin tubes 10 are supported by a front bundle cap 19 that is fixed to the front end of the center pipe 12 by means of a resin screw 18 (FIG. 3). The front bundle cap 19 is formed with six supporting holes through which the front ends of the nonconductive tubes 10 extend. An O-ring 20, an O-ring presser 21 and an O-ring 22 are fitted one upon another around the front ends of the nonconductive resin tubes 10 protruding from the supporting holes. A sub-muzzle 23 having a forwardly narrowing inner surface is further put on the front ends of the tubes 10. The sub-muzzle 23, O-ring presser 21 and front bundle cap 19 are fixed to the gun body 11 through a front bundle holder 24 that is threaded into the front end of the gun body 11.

The nonconductive resin tubes 10 are made e.g. from tetrafluoroethylene and each covered with an aluminum foil 25 and an aluminum tube 26 as a conductive layer.

A hose connector 27 forming the paint inlet is connected to the rear of the charging portion. To the hose connector 27 is connected a feed hose through which powder paint is supplied. The hose connector 27 is fixed to the rear barrel cap 13, which is provided at the rear end of the gun body 11, through a rear cap nut 28 and a rear cap 29. In the rear cap 29 is fitted an orifice 30 having a passage that is restricted at its central portion. To the rear end of the orifice 30 is connected an acceleration air inlet pipe 31 for introducing acceleration air.

The pre-charging portion is provided between the orifice 30 and the rear bundle cap 15 and comprises a nonconductive resin ring 33 and a flow member 32 for directing the powder paint discharged from the orifice 30 together with air toward the inner surface of the nonconductive resin ring 33. The flow member 32 is formed with a plurality of holes that extend outwardly and forwardly. After passing through the holes, the powder paint is fed swirling in the nonconductive resin ring 33 and brought into contact with its inner surface. It is thus dispersed uniformly.

The nonconductive resin ring 33 is made e.g. from tetrafluoroethylene. It gives electric charges to powder paint when the paint comes into contact with it. The orifice 30 and flow member 32 are also made from tetrafluoroethylene, so that the powder paint is charged again when it passes through these members.

Since the powder paint is charged to one polarity when passing through the orifice 30, flow member 32 and nonconductive resin ring 33, these members are charged to the opposite polarity to the same degree as is the paint. In order to discharge such electric charges, a rear cap ring 34 made of aluminum is put on the orifice 30 and electrically connected through the aluminum rear bundle holder 14 to an earth electrode 35 carried on the rear bundle holder 14.

The rear bundle holder 14, to which is connected the earth electrode 35, is also kept in contact with the aluminum foils 25 and the aluminum tubes 26 surrounding the nonconductive resin tubes 10. Thus, any electric charges that may be produced in the nonconductive resin tubes can be discharged through the earth electrode 35.

On the other hand, a muzzle 36 forming the paint outlet is connected to the front end of the charging portion (FIG. 3). The muzzle 36 is mounted to the front end of the gun body 11 by means of a front cap nut 37. Between the muzzle 36 and sub-muzzle 23 is fitted a flow agitator 38 to uniformly agitate the powder paint that has come out of the sub-muzzle 23.

A pattern cap 39 is put on the front part of the muzzle 36. It serves to form a blow pattern of the powder paint.

The sub-muzzle 23, flow agitator 38, muzzle 36 and pattern cap 39 are made from the same material as the nonconductive resin tubes 10 such as tetrafluoroethylene, so that the powder paint is electrically charged when it passes through these members. Muzzle earth rings 40 and 41 are provided between the muzzle 36 and pattern cap 39 and on the flow agitator 38, respectively. The muzzle earth rings 40, 41 are electrically connected through the aluminum front bundle holder 24 to aluminum tubes 26 surrounding the nonconductive resin tubes 10. Thus, even though the pattern cap 39, muzzle 36, flow agitator 38 and sub-muzzle 23 are electrically charged in an opposite polarity to the powder paint, such electric charges are discharged through the earth electrode 35.

In use, the powder paint feed hose is connected to the hose connector 27. Powder paint is introduced into the gun together with carrier air. Accelerated air is introduced through the acceleration air inlet pipe 31 into the orifice 30. The carrier air and acceleration air are uniformly mixed together while passing through the orifice 30. The powder paint is fed through the orifice 30 and flow member 32 at high speed and is dispersed uniformly when fed swirling through the nonconductive resin ring 33. The paint thus dispersed uniformly enters the nonconductive resin tubes 10. The paint is electrically charged before entering the nonconductive resin tubes 10 by being brought into contact with the orifice 30, flow member 32 and nonconductive resin ring 33. The powder paint is further charged while passing through the nonconductive resin tubes 10. Finally, it is charged by coming into contact with the inner surfaces of the sub-muzzle 23, flow agitator 38, muzzle 36 and pattern cap 39. The powder paint is thus electrically charged reliably and sufficiently before it is discharged through the pattern cap 39.

The orifice 30, flow member 32, rear bundle cap 15 and nonconductive resin tubes, which form the frictional electrification gun, are separable from one another. Thus, if one of the nonconductive resin tubes 10 is worn out, it can be replaced with a new one.

Moreover, since the nonconductive resin tubes 10 are straight tubes, their inner surfaces can be cleaned easily by blowing air thereinto. Thus, it is possible to change the paint color easily.

In order to stably and efficiently supply electric charges to powder paint in the pre-charging and charging portions, it is preferable to discharge as quickly as possible the electric charges produced on the surface of the nonconductive resin ring 33 or the nonconductive resin tube 10, which are opposite in polarity to the charges in the powder paint, through the conductive layers around them.

Figure 5:
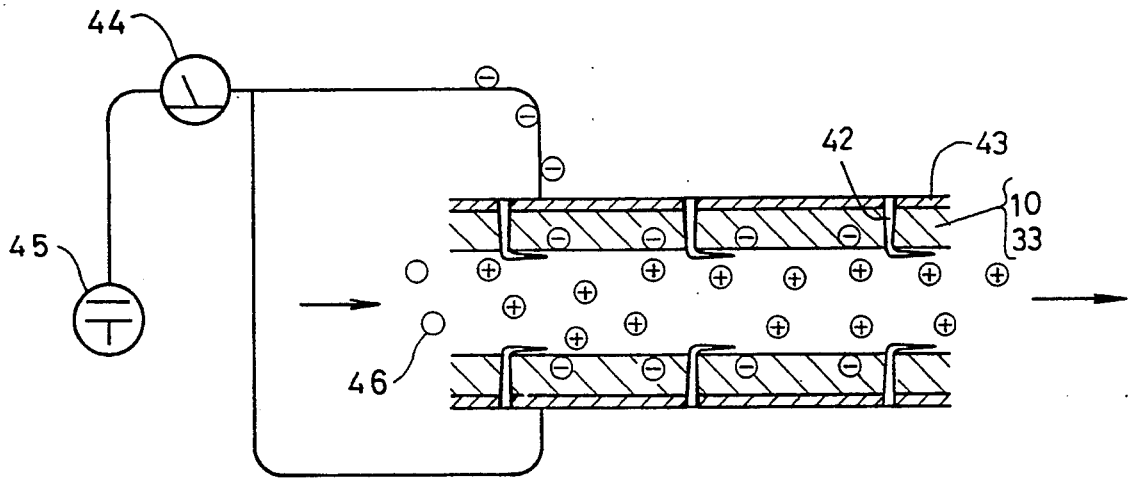
FIG. 5 is a partial schematic view of another embodiment of this invention.

Thus, as shown in FIG. 5, needle-like electrodes 42 are inserted at predetermined intervals into the nonconductive resin ring 33 in the pre-charging portion and the nonconductive resin tubes 10 so that their ends protrude from the inner periphery of the nonconductive resin tubes 10 while kept in contact with an outer conductive layer 43. With this arrangement, the electric charges produced on the surfaces of the nonconductive resin ring 33 and nonconductive resin tubes 10, which are opposite in polarity to the electric charges produced in the powder paint, flow smoothly through the needle-like electrodes to the outer conductive layers, so that they will never be accumulated. Thus powder paint can be electrically charged smoothly. An earth wire 45 is connected to the conductive layers 43 through an ammeter 44. The conductive layer 43 in FIG. 5 corresponds to the aluminum bundle cap presser 17 of the nonconductive resin ring 33 and the aluminum foil 25 and aluminum tube 26 surrounding each nonconductive resin tube 10. In FIG. 5, powder paint is designated by numeral 46. If this powder paint is an epoxy or polyester paint, the powder paint will be positively charged, while the surfaces of the nonconductive resin ring 33 and nonconductive resin tubes 10 will be negatively charged.

In order to confirm the effect of the needle-like electrodes 42, we measured the charged amounts of the powder paint when providing and not providing the nonconductive resin ring 33 with the needle-like electrodes 42 and compared the difference therebetween. The results are shown in Tables 1 and 2. Similarly, we measured the charged amounts of the powder paint when providing and not providing the nonconductive resin tubes 10 with the needle-like electrodes 42 and compared the difference therebetween. The results are shown in Tables 3 and 4. The nonconductive ring 33 and nonconductive resin tubes 10 used in this test were both made of tetrafluoroethylene.

From the results, it was found out that the greater the amount of discharge, the greater the difference in charged amounts. This is presumably because the negative charges produced on the surfaces of the nonconductive resin ring 33 and nonconductive resin tubes 10 are instantly discharged through the needle-like electrodes 42 and as a result the powder paint can be positively charged smoothly by frictional contact with them.

TABLE 1

| Polyester paint (white) | | | | |
|---|---|---|---|---|
| | | | Current value (μA) Non-conductive resin ring (pre-charging portion) | |
| Discharge volume (g/min) | Carrier air pressure (kg/cm²) | Acceleration air pressure (kg/cm²) | Without needle-like electrode | With needle-like electrode |
| 100 | 2.5 | 2.0 | 2.0 | 2.5 |
| | | 2.5 | 2.3 | 2.6 |
| | | 3.0 | 2.3 | 3.0 |
| 150 | 3.0 | 2.0 | 3.0 | 3.5 |
| | | 2.5 | 3.3 | 3.8 |
| | | 3.0 | 3.5 | 4.2 |
| 200 | 3.5 | 2.0 | 3.2 | 4.9 |
| | | 2.5 | 3.4 | 5.5 |
| | | 3.0 | 3.8 | 5.7 |

TABLE 2

| Epoxy paint (white) | | | | |
|---|---|---|---|---|
| | | | Current value (μA) Non-conductive resin ring (pre-charging portion) | |
| Discharge volume (g/min) | Carrier air pressure (kg/cm²) | Acceleration air pressure (kg/cm²) | Without needle-like electrode | With needle-like electrode |
| 100 | 2.5 | 2.0 | 2.1 | 3.2 |
| | | 2.5 | 2.5 | 3.5 |
| | | 3.0 | 3.0 | 3.7 |
| 150 | 3.0 | 2.0 | 3.0 | 3.7 |
| | | 2.5 | 3.2 | 3.9 |
| | | 3.0 | 3.5 | 4.1 |
| 200 | 3.5 | 2.0 | 3.3 | 6.0 |
| | | 2.5 | 3.5 | 6.2 |
| | | 3.0 | 3.8 | 6.7 |

TABLE 3

| Polyester paint | | | | |
|---|---|---|---|---|
| | | | Current value (μA) Non-conductive resin ring (pre-charging portion) | |
| Discharge volume (g/min) | Carrier air pressure (kg/cm²) | Acceleration air pressure (kg/cm²) | Without needle-like electrode | With needle-like electrode |
| 100 | 2.5 | 2.0 | 2.0 | 2.6 |
| | | 2.5 | 2.2 | 2.6 |
| | | 3.0 | 2.5 | 3.2 |
| 150 | 3.0 | 2.0 | 3.0 | 3.7 |
| | | 2.5 | 3.2 | 3.8 |
| | | 3.0 | 3.4 | 4.2 |
| 200 | 4.0 | 2.0 | 4.1 | 5.2 |
| | | 2.5 | 4.4 | 5.3 |
| | | 3.0 | 4.6 | 5.6 |

TABLE 4

| Acryl polyester paint | | | | |
|---|---|---|---|---|
| | | | Current value (μA) Non-conductive resin ring (pre-charging portion) | |
| Discharge volume (g/min) | Carrier air pressure (kg/cm²) | Acceleration air pressure (kg/cm²) | Without needle-like electrode | With needle-like electrode |
| 100 | 2.5 | 2.0 | 2.7 | 3.2 |
| | | 2.5 | 3.0 | 3.6 |
| | | 3.0 | 3.3 | 4.1 |
| 150 | 3.0 | 2.0 | 3.5 | 4.3 |
| | | 2.5 | 3.7 | 4.5 |
| | | 3.0 | 3.9 | 4.7 |
| 200 | 4.0 | 2.0 | 4.6 | 6.0 |
| | | 2.5 | 4.8 | 6.2 |
| | | 3.0 | 5.1 | 6.7 |

What is claimed is:

1. A frictional electrification gun for use in electrostatic painting comprising a gun body having a paint inlet at one end thereof and a paint outlet at the other end, and a charging portion comprising a nonconductive resin tube, characterized in that there is provided between said paint inlet and said charging portion a pre-charging portion comprising a nonconductive resin ring and a flow member for directing powder paint introduced through the paint inlet toward the inner wall surface of said nonconductive resin ring.

2. A frictional electrification gun for use in electrostatic painting as claimed in claim 1 wherein a pipe for introducing acceleration air is connected to a passage extending from said paint inlet to said flow member and wherein an orifice is provided between the point at which said pipe is connected to said passage and said flow member.

3. A frictional electrification gun for use in electrostatic painting as claimed in claim 1 wherein said charging portion comprises a plurality of straight nonconductive resin tubes arranged parallel to one another.

4. A frictional electrification gun for use in electrostatic painting as claimed in claim 1 wherein conductive layers are provided on the outer surfaces of said nonconductive resin tube and said nonconductive resin ring and wherein said nonconductive resin tube and said nonconductive resin ring are grounded through said conductive layers.

5. A frictional electrification gun for use in electrostatic painting as claimed in claim 4 wherein needle-like electrodes are inserted in said nonconductive resin tube at predetermined intervals such that said electrodes are kept in contact with said conductive layers and their tips protrude inwardly from the inner wall of said nonconductive resin tube.

6. A frictional electrification gun for use in electrostatic painting as claimed in claim 4 wherein needle-like electrodes are inserted in said nonconductive resin ring at predetermined intervals such that said electrodes are kept in contact with said conductive layers and their tips protrude inwardly from the inner wall of said nonconductive resin ring.

7. A frictional electrification gun for use in electrostatic painting as claimed in claim 2 wherein said charging portion comprises a plurality of straight nonconductive resin tubes arranged parallel to one another.

8. A frictional electrification gun for use in electrostatic painting as claimed in claim 2 wherein conductive layers are provided on the outer surfaces of said nonconductive resin tube and said nonconductive resin ring and wherein said nonconductive resin tube and said nonconductive resin ring are grounded through said conductive layers.

9. A frictional electrification gun for use in electrostatic painting as claimed in claim 3 wherein conductive layers are provided on the outer surfaces of said nonconductive resin tube and said nonconductive resin ring and wherein said nonconductive resin tube and said nonconductive resin ring are grounded through said conductive layers.

10. A frictional electrification gun for use in electrostatic painting as claimed in claim 7 wherein conductive layers are provided on the outer surfaces of said nonconductive resin tube and said nonconductive resin ring and wherein said nonconductive resin tube and said nonconductive resin ring are grounded through said conductive layers.

11. A frictional electrification gun for use in electrostatic painting as claimed in claim 5 wherein needle-like electrodes are inserted in said nonconductive resin ring at predetermined intervals such that said electrodes are kept in contact with said conductive layers and their tips protrude inwardly from the inner wall of said nonconductive resin ring.

* * * * *